US008531390B2

(12) United States Patent
Kim et al.

(10) Patent No.: US 8,531,390 B2
(45) Date of Patent: Sep. 10, 2013

(54) METHOD AND APPARATUS FOR DRIVING ELECTROPHORETIC DISPLAY

(75) Inventors: Gwan-Hyung Kim, Seoul (KR); Joo-Hoon Lee, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 675 days.

(21) Appl. No.: 12/683,767

(22) Filed: Jan. 7, 2010

(65) Prior Publication Data

US 2010/0171752 A1 Jul. 8, 2010

(30) Foreign Application Priority Data

Jan. 7, 2009 (KR) ..... 10-2009-0001277

(51) Int. Cl.
*G09G 3/34* (2006.01)

(52) U.S. Cl.
USPC ..... 345/107

(58) Field of Classification Search
USPC ..... 345/107, 214, 101; 359/296
See application file for complete search history.

(56) References Cited

U.S. PATENT DOCUMENTS

| | | | | |
|---|---|---|---|---|
| 6,504,524 | B1 | 1/2003 | Gates | |
| 7,791,782 | B2 * | 9/2010 | Paolini et al. | 345/107 |
| 7,859,742 | B1 * | 12/2010 | Chiu et al. | 345/107 |
| 2006/0209009 | A1 | 9/2006 | Schlangen et al. | |
| 2007/0052648 | A1 | 3/2007 | Zhou et al. | |
| 2007/0075962 | A1 | 4/2007 | Zhou et al. | |
| 2008/0211833 | A1 * | 9/2008 | Inoue | 345/690 |
| 2010/0315391 | A1 * | 12/2010 | Kokeguchi | 345/205 |

FOREIGN PATENT DOCUMENTS

| | | |
|---|---|---|
| EP | 1 950 729 | 7/2008 |
| KR | 1020060073627 | 6/2006 |
| KR | 1020060080930 | 7/2006 |
| WO | WO 2008102604 A1 * | 8/2008 |

* cited by examiner

*Primary Examiner* — Allison Walthall
(74) *Attorney, Agent, or Firm* — The Farrell Law Firm, P.C.

(57) ABSTRACT

An ElectroPhoretic Display (EPD) for changing a display is provided. An apparatus having the EPD applies a driving voltage with a periodic pulse to first color particles for a voltage applying period of the first color particles if a current temperature is below a predetermined temperature. The apparatus applies a driving voltage with a pulse that is kept at the same level as applied to second color particles for a voltage applying period of the second color particles. The first color particles have a higher mobility than the second color particles.

6 Claims, 8 Drawing Sheets

METHOD AND APPARATUS FOR DRIVING ELECTROPHORETIC DISPLAY

PRIORITY

This application claims priority under 35 U.S.C. §119(a) to an application entitled "Method And Apparatus For Driving Electrophoretic Display" filed in the Korean Intellectual Property Office on Jan. 7, 2009 and assigned Serial No. 10-2009-0001277, the content of which is incorporated herein by reference.

BACKGROUND OF THE INVENTION

1. Field of the Invention

The present invention relates generally to an ElectroPhoretic Display (EPD), and more particularly, to a method and an apparatus for driving an EPD in accordance with an ambient temperature.

2. Description of the Related Art

The concept of electronic paper incorporates a new display device having advantages of existing display devices and printed paper. Electronic paper is reflective display, which has the most superior viewing characteristics among display media, such as, high resolution, wide viewing angle, and bright white background, like the existing paper and ink. Electronic paper can be implemented on any substrate, such as plastic, metal, paper, and the like. Electronic paper maintains an image even after the power supply is interrupted via a memory function, and requires no backlight power. Thus, the life span of a battery of a mobile communication terminal can be lengthened, and the manufacturing cost and the weight of the terminal can be reduced. Additionally, since electronic paper can be implemented in a wide area in the same manner as existing paper, it can be applied to a larger-scale display.

Electronic paper can be implemented using an EPD. The EPD displays data in white or black in accordance with an applied voltage, and is constructed through the application of electrophoresis and microcapsules. A general cell structure of such an EPD is illustrated in FIG. 1. FIG. 1 is a sectional view illustrating an operation principle of the EPD. The EPD is constructed by manufacturing a transparent microcapsule having black particles 40 and white particles 30 included in a colored fluid. The microcapsule is combined with a binder 50, and then the microcapsule combined with the binder is positioned between upper and lower transparent electrodes 20 that are in contact with an inner side of a substrate 10. If a positive voltage is applied to the electrode 20, ink corpuscles that are negatively charged move toward the surface of the EPD to display the color of the corpuscles. By contrast, if a negative voltage is applied to the electrode 20, the negatively charged ink corpuscles move downward. By this method, a text or an image can be displayed.

The EPD is dependent upon an electrostatic movement of particles floating in a transparent suspension. If a positive voltage is applied, positively charged white particles 30 electrostatically move to an electrode of an observer side, and at this time, the white particles 30 reflect light. By contrast, if a negative voltage is applied, the white particles 30 move to an electrode that is away from the observer, and the black particles 40 move to an upper part of the capsule to absorb the light, so that the observer observes the black color. Once the movement has occurred at any polarity, the particles remain in their positions even when the applied voltage is interrupted, which requires the application of a memory device having bistability. An electrophoretic capsule using a single kind of particles is constructed in a manner that a transparent high-polymer capsule has white charged particles floating in a fluid that is dyed a dark color.

The movement of the black particles 40 and the white particles 30, which constitute the EPD, is affected by the level of the voltage being applied to the particles and time for applying the voltage. As the level of the voltage becomes higher, and the time for applying the voltage becomes longer, the power of moving the particles becomes greater. A graph of FIG. 2A illustrates the movement of particles constituting the EPD in comparison to the time for applying the voltage in a 25° C. environment. Referring to FIGS. 2A and 2B, the particles abruptly move in the time of approximately 250 ms, and the amount of movement decreases after the rough movement is completed.

The mobility of the EPD particles is closely affected by an ambient temperature. This is because when the charged EPD particles move, they encounter higher resistance at a temperature lower than the ambient temperature, and encounter lower resistance at a temperature higher than the ambient temperature.

For example, when the same voltage as illustrated in FIG. 2A is applied to the particles at a temperature below −10° C., the movement of the particles is shown in FIG. 2B. The movement of the particles is completed at approximately 350 ms. Thus, the reaction time is lengthened, when compared to that of the ambient temperature shown FIG. 2A. Further, the contrast of the particles is also lowered.

The reaction times of the white particles 30 and the black particles 40 differ from each other. Accordingly, if the EPD is driven by applying a voltage of the same level for the same time regardless of the temperature, the respective particles cannot completely move in a low-temperature environment. This can result in an afterimage of data previously displayed that remains on a display screen.

SUMMARY OF THE INVENTION

The present invention has been made to address at least the above problems and/or disadvantages and to provide at least the advantages described below. Accordingly, an aspect of the present invention provides a method and an apparatus for driving an EPD in consideration of an ambient temperature.

Another aspect of the present invention provides a method and an apparatus for driving an EPD that can clearly display data regardless of an ambient temperature.

According to one aspect of the present invention, a method is provided for driving an ElectroPhoretic Display (EPD) so that a device having the EPD including first color particles and second color particles changes a display as an electrophoresis element. A driving voltage with a periodic pulse is applied to the first color particles for a voltage applying period of the first color particles when the current temperature is below a predetermined temperature. The first color particles have a higher mobility than the second color particles. A driving voltage of a pulse that is kept at the same level is applied to the second color particles for a voltage applying period of the second color particles.

According to another aspect of the present invention, an apparatus is provided for driving an ElectroPhoretic Display (EPD) for changing a display. The apparatus includes an EPD including first color particles and second color particles as an electrophoresis element. The apparatus also includes a driving unit that applies a driving voltage in the form of a pulse to the EPD. The apparatus further includes a control unit that controls the driving unit to apply a driving voltage with a periodic pulse to the first color particles for a voltage applying period of the first color particles when a current temperature is below a predetermined temperature, and controlling the driving unit to apply a driving voltage with a pulse that is kept at the same level as applied to the second color particles for a voltage applying period of the second color particles. The first color particles preferably have a higher mobility than the second color particles.

BRIEF DESCRIPTION OF THE DRAWINGS

The above and other aspects, features and advantages of the present invention will be more apparent from the following detailed description when taken in conjunction with the accompanying drawings, in which.

DETAILED DESCRIPTION OF EMBODIMENTS OF THE PRESENT INVENTION

Figure 1:
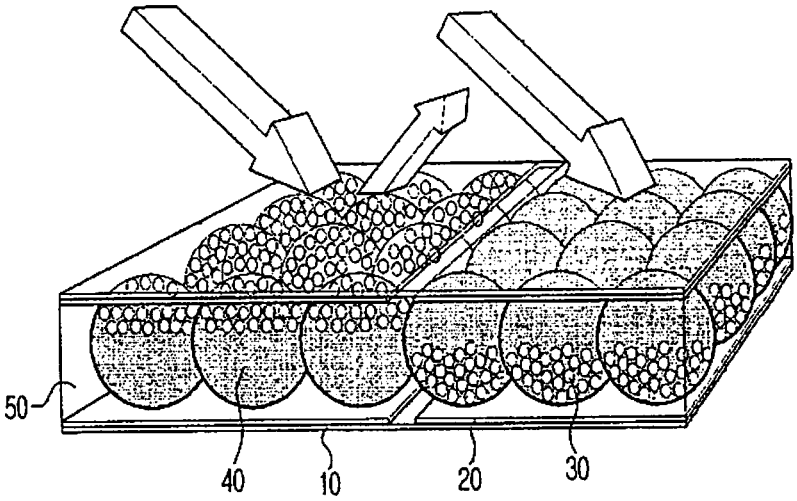
FIG. 1 is a diagram illustrating a general EPD structure.

Embodiments of the present invention are described in detail with reference to the accompanying drawings. The same or similar elements may be designated by the same or similar reference numerals although they are shown in different drawings. Detailed descriptions of constructions or processes known in the art may be omitted to avoid obscuring the subject matter of the present invention.

Figure 3:
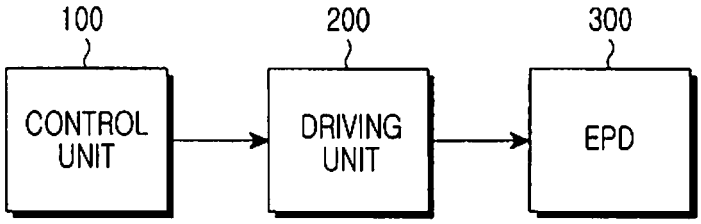
FIG. 3 is a diagram illustrating the configuration of an EPD device, according to an embodiment of the present invention.

The configuration of an EPD driving apparatus to which the present invention is applied is illustrated in FIG. 3. The EPD driving apparatus includes a control unit 100, a driving unit 200, and an EPD 300.

Figure 4:
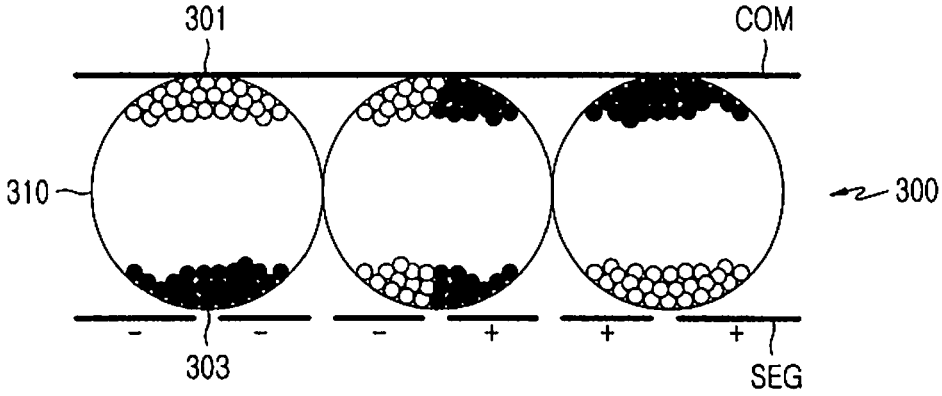
FIG. 4 is a diagram illustrating an EPD structure, according to an embodiment of the present invention is applied.

The EPD 300 is a display device that displays data in white or black in accordance with a voltage being applied to both ends thereof it's a cross section of the EPD 300 is illustrated in FIG. 4. The EPD 300 has a plurality of micro capsules 310 as an electrophoresis element, composed of white particles 301, black particles 303, and fluid, which are positioned between a COM electrode and an SEG electrode. In an embodiment of the present invention, driving voltages in the form of a pulse are applied to respective electrodes. Specifically, an operating voltage is applied to the SEG electrode, and a reference voltage is applied to the COM electrode.

The control unit 100 controls the operation of the EPD driving apparatus, determines data to be displayed on the EPD 300, and controls the operation of the driving unit 200 in accordance with determined data and a current temperature.

The driving unit 200, under the control of the control unit 100, applies the operating voltage in the form of a pulse to the SEG electrode of the EPD 300, and applies the reference voltage in the form of a pulse to the COM electrode. Accordingly, the driving voltage is applied to the EPD 300, and the white particles 301 and the black particles 303 move in accordance with a difference between the voltages applied to both electrodes and the corresponding voltage direction.

In an embodiment of the present invention, the reference pulse according to the reference voltage is a pulse having an amplitude from level L to level H. In a period when the pulse is kept at level L, the reference pulse is for the black particles 303, while in a period when the pulse is kept at level H, the reference pulse is for the white particles 301. The level L and the level H may have values of 0V and 15V, respectively. The waveform of the operating pulse according to the operating voltage is determined in accordance with the transition of a display state of the EPD 300, and has an amplitude from level L to level H.

Figure 5:
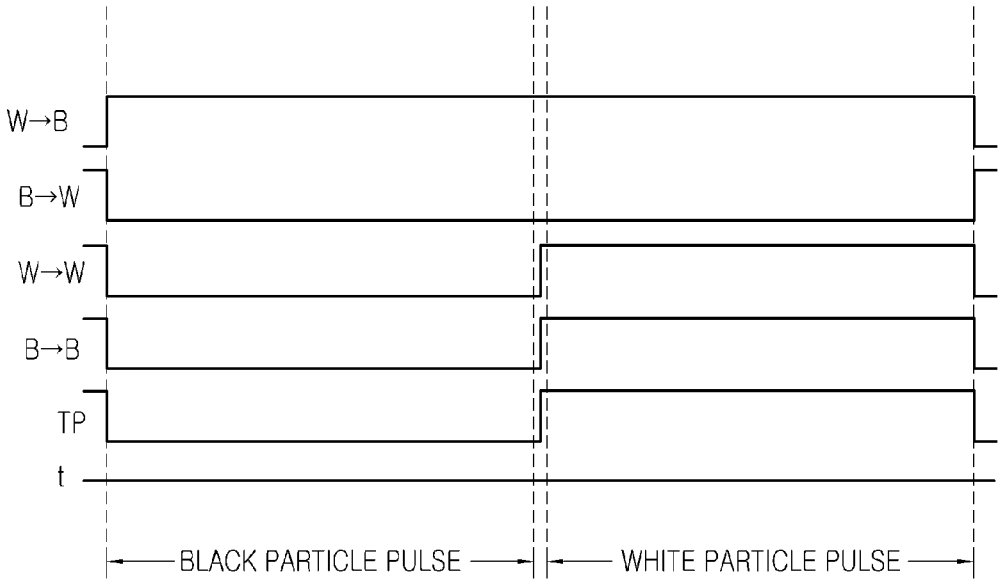
FIG.5 (PRIOR ART)
FIG. 5 is a diagram illustrating a driving voltage pulse in a single mode.

The conventional operating pulses are shown in FIG. 5 in accordance with the transition of the display state. In order to transition the display state from white to black (W→B), when the reference pulse TP is changed from level L to level H, the operating pulse is kept at H level for a period of the reference pulse. Accordingly, a driving voltage of 15V is applied to the EPD 300 while the reference pulse TP is at level L, and the black particles 303 move toward the SEG electrode. By contrast, in order to transition the display state from black to white (B→W), the operating pulse is kept at level L for a period of the reference pulse. Accordingly, a driving voltage of −15V is applied to the EPD 300 while the reference pulse TP is at level H, and the white particles 301 move toward the electrode SEG. If there is no transition of the display state, that is, if white or black is kept constant (W→W) or (B→B), the reference pulse and the operating pulse have the same waveform, and thus the applied driving voltage is kept at 0V. Accordingly, the color particles 301 and 303 do not move.

Figure 2A:
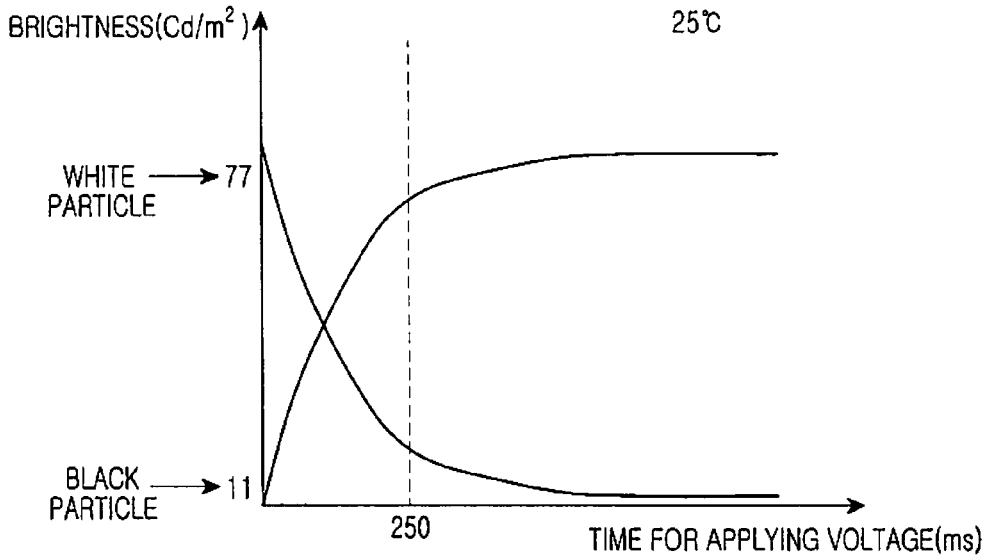
FIGS. 2A and 2B are graphs illustrating the mobility of EPD color particles in accordance with a temperature.
Figure 2B:
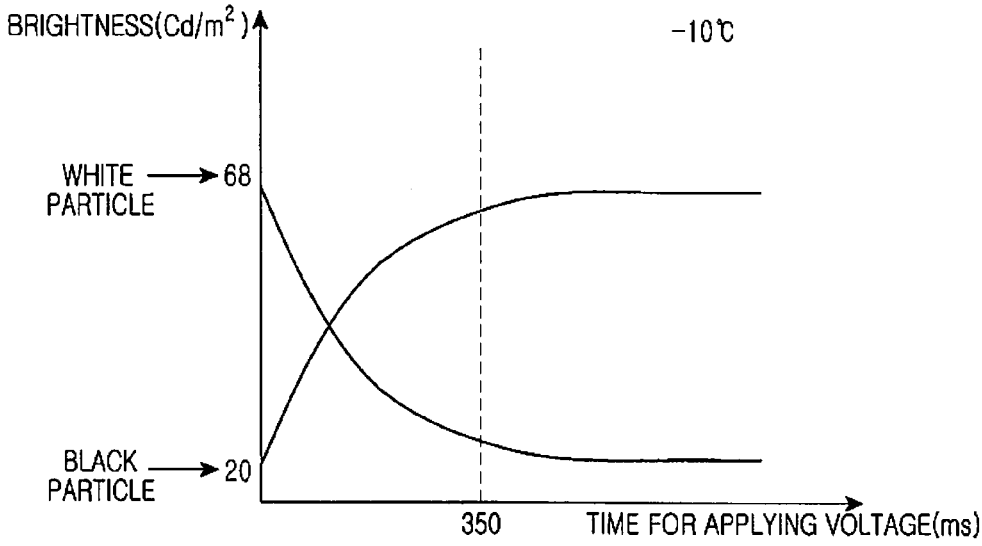

However, as illustrated in FIGS. 2A and 2B, the mobility of the color particles 301 and 303 of the EPD 300 changes in accordance with the ambient temperature. By controlling the level of the voltage being applied to the respective electrodes and the time for applying the voltage in accordance with the above-described characteristics, the same mobility can be secured with respect to the color particles 301 and 303 of the EPD 300 under any circumstances.

When adjusting the voltage level, it is difficult to satisfy a DC balancing condition, which should be satisfied during the driving of the EPD 300. It is also hard to avoid an overdrive state. Accordingly, it is preferable to adjust the time for applying the voltage. The DC balancing condition requires that the sum of voltage applying time corresponding to the voltages in positive (+) and negative (−) directions be the same when the voltage is applied to the EPD particles 301 and 303. The overdrive state is a state in which the voltage is applied even after grayscales are saturated.

When adjusting the time for applying the voltage, if it is intended to move the color particles 301 and 303 at a low temperature in the same manner as the ambient temperature, the EPD driving time at the low temperature is abruptly increased. The driving time is the time that is required to apply the driving voltage in order to completely change the display state on the EPD 300 from white to black or from black to white. As the temperature is lowered, the movement of the color particles 301 and 303 is gradually diminished. In an embodiment of the present invention, the low temperature is below an inactive temperature, which means that movement of the EPD particles 301 and 303 is weakened in comparison to that at the ambient temperature, e.g., a temperature below 0° C.

If the temperature is −20° C., a driving time of about one second is required for the display to change. Specifically, an operating pulse for the white particles 301 should be applied for 0.5 sec, and an operating pulse for the black particles 303 should be applied for 0.5 sec. thereby requiring one second to display the data. The time required to change the display without an afterimage at ambient temperature is 500 ms. Therefore, when compared to the ambient temperature, it takes about double the time at −20° C. However, a user may feels that the display changing time is too long when a device requires a prompt change of the display state. Accordingly, even though the voltage applying period is controlled in accordance with the temperature, a maximum threshold value of the voltage applying period should also be set.

Figure 6:
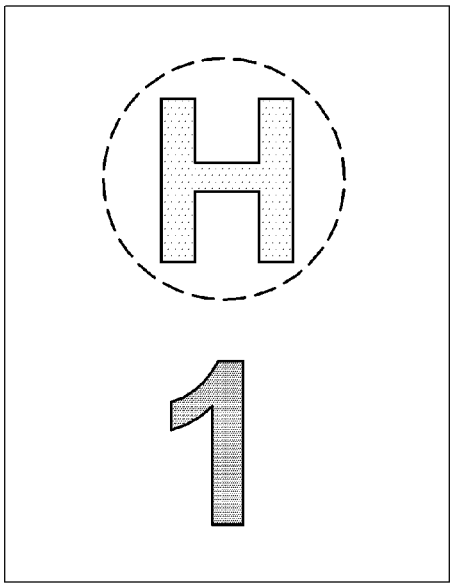
FIG.6 (PRIOR ART)
FIG. 6 is a diagram illustrating a conventional display screen.

As described above, the maximum threshold value that is set cannot guarantee that mobility of the color particles 301 and 303 at every temperature lower than the inactive temperature will be as high as mobility of the color particles 301 and 303 at the ambient temperature. Accordingly, if the data being displayed is changed in a state in which the driving voltage cannot be sufficiently applied at low temperature and at which the mobility of the color particles 301 and 303 cannot be guaranteed, the contrast of the screen of the EPD 300 deteriorates, and an afterimage of the data previously displayed remains. For example, if the display data is changed from "H" to "1" in a state in which the maximum threshold value of the voltage applying period for certain EPD particles is set to 300 ms and the current temperature is −20° C., an afterimage as shown in FIG. 6 remains. In spite of the currently displayed data of "1," an afterimage of the previously displayed data of "H" still remains.

The afterimage described above is caused when the reaction speeds of the black particles 303 and the white particles 301 in the EPD 300 are not equal to each other. In order for the two particles 301 and 303 to change in complete symmetry, sufficient time must be given so that the white particles 303 can reach a saturation state. If insufficient time is given, electric fields, i.e. a reference pulse and an operating pulse, are applied to the black particles 301 before the change to the white color could be completed, and thus the afterimage remains and overdrive occurs during the image update thereafter. This not only causes the afterimage to remain but also affects the lifetime of the panel of the EPD 300.

In an embodiment of the present invention, the waveforms of the reference pulse and the operating pulse are adjusted to offset the difference in reaction speed between the white particles 301 and the black particles 303. Specifically, when electric fields are applied to the color particles 301 and 303 at a low temperature below the inactive temperature, a driving voltage composed of a pulse keeping the same level, or a driving voltage composed of several short pulses, is applied for the same voltage applying period in accordance with the kind of the color particles 301 and 303. When applying the driving voltage composed of several short pulses, the actual voltage applying time to the color particles is shorter than the whole voltage applying time, and thus the movement of the color particles is decreased in comparison to the application of the single continuous pulse at the same level. By adjusting the waveform of the pulse, the degree of force being applied to the EPD particles can be adjusted.

Figure 7:
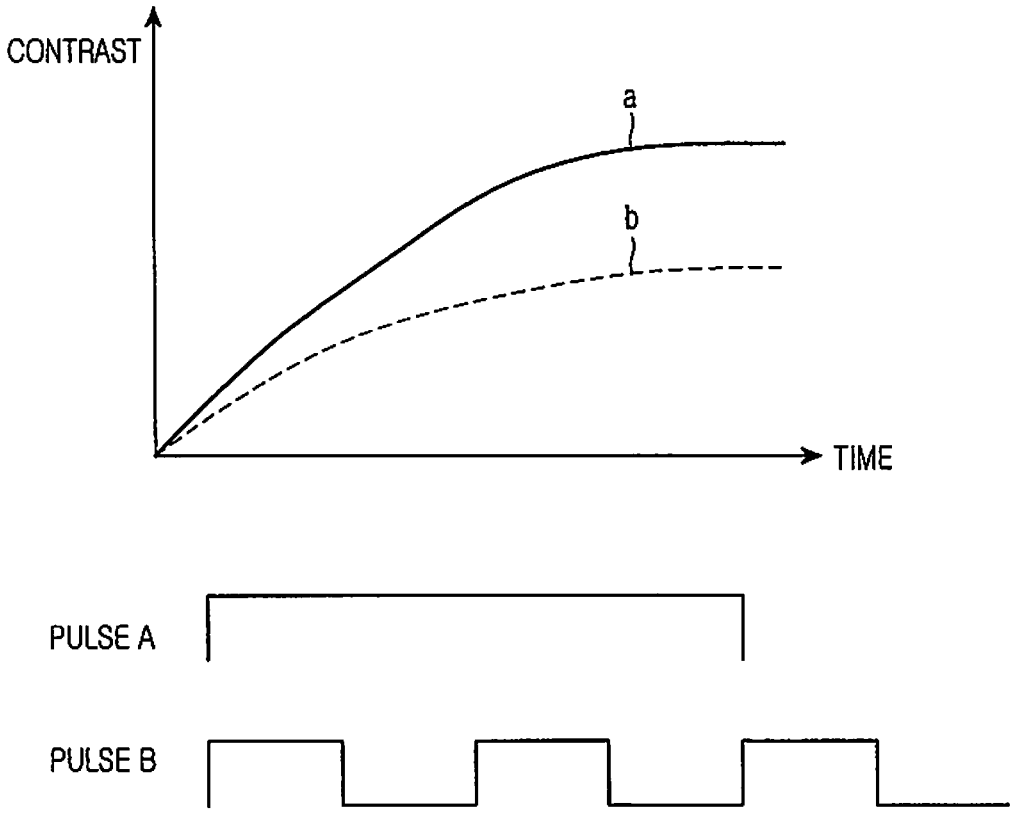
FIG. 7 is a graph illustrating a difference between contrast levels in accordance with pulse waveforms.

FIG. 7 is a graph illustrating the degree of contrast of the display screen of the EPD 300 when a pulse a keeping the same level for a certain time and a periodic pulse b for the same time are applied.

The degree of contrast when the pulse a keeping the same level for a certain time is applied is higher than the degree of contrast when the periodic pulse b for the same time is applied. This means that the mobility of the color particles 301 and 303 when the driving voltage of the periodic pulse is applied for the same time is smaller than the mobility of the color particles when the driving voltage of the pulse keeping the same level is applied.

Using this phenomenon, a periodic pulse is applied when moving the black particles 303, which have a relatively high reaction speed, and a pulse continuously keeping the same level is applied when moving the white particles 301, which have a relatively low reaction speed. Accordingly, the black particles 303 and the white particles 301 move at similar speeds at a low temperature, and thus even in the case in which an insufficient voltage applying period is designated, the display change can be performed without the afterimage although the whole contrast is somewhat weakened. The DC balancing condition is satisfied and the overdrive state can be avoided.

In an embodiment of the present invention, the EPD 300 is driven in two modes in accordance with the temperature. Specifically, at a temperature above the reference temperature, the EPD 300 is driven in a single mode in which the driving voltage of the pulse, which is continuously kept at the same level, is applied for the voltage applying period. At a temperature below the reference temperature, the EDP 300 is driven in a multi-mode in which the driving voltage of the periodic pulse or the driving voltage of the pulse that is kept at a constant level is applied in accordance with the moving characteristics of the color particles 301 and 303. The reference temperature may be preset to a temperature below the inactive temperature.

Figure 8A:
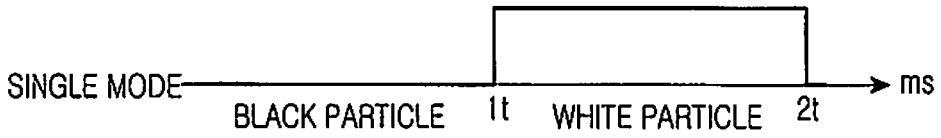
FIGS. 8A and 8B are diagrams illustrating reference pulses, according to an embodiment of the present invention.
Figure 8B:
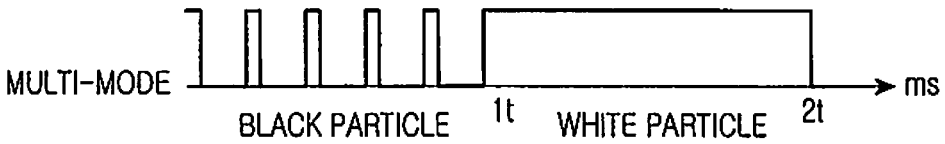

FIG. 8A is a diagram illustrating a single mode application of the reference pulse, according to an embodiment of the present invention. FIG. 8B is a diagram illustrating a multi-mode application of the reference pulse, according to an embodiment of the present invention. The reference pulses as illustrated in FIGS. 8A and 8B, may be changed depending upon the embodiments of the present invention.

Referring to FIG. 8A, the reference pulse in a single mode is composed of a pulse having a continuous level value. One period of the reference pulse is 2t, which is the sum of the voltage applying period t of the white particles 301 and the voltage applying period t of the black particles 303. The period "2t" is determined in consideration of the mobility of the white particles 301 at an ambient temperature.

Referring to FIG. 8B, the reference pulse in a multi-mode is composed of a periodic pulse for the voltage applying period for the black particles 303, and a pulse kept at a constant level value for the voltage applying period for the white particles 301. This makes the moving speed of the black particles 303 similar to the moving speed of the white particles 301 by suppressing the mobility of the black particles 303 when the temperature is below the inactive temperature. The one period of the reference pulse, 2t, is determined based on the mobility of the white particles 301 at a certain temperature below the inactive temperature, and does not exceed the predetermined maximum threshold value. The maximum threshold value, for example, is a time period in which a user can endure the display change, and may be approximately 800 ms. In one period of the reference pulse, the pulse rate of the periodic pulse being applied for the voltage applying period for the black particles 303 is determined in accordance with a difference in mobility between the white particles 301 and the black particles 303 at the certain temperature. In another embodiment of the present invention, different periods may be provided in accordance with specified temperature sections, and a plurality reference pulses having different waveforms may exist in a multi-mode.

Figure 9:
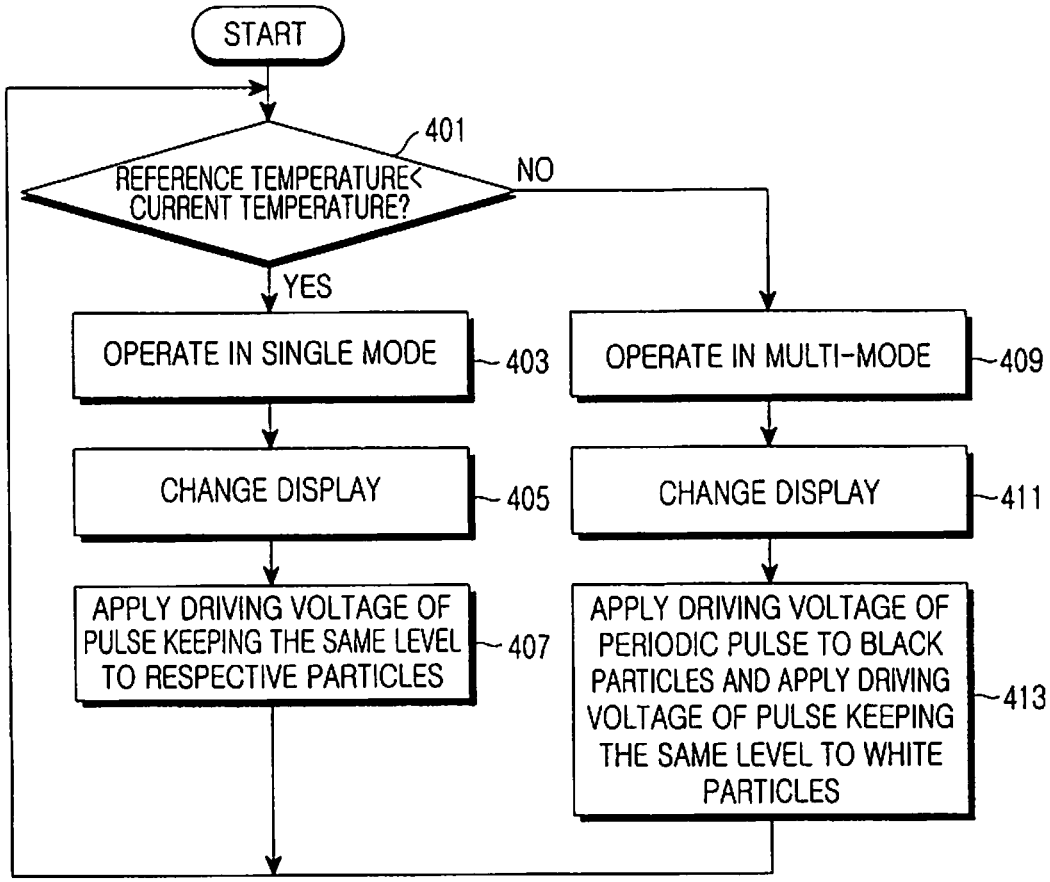
FIG. 9 is a flow diagram illustrating an operation process of an EPD device, according to an embodiment of the present invention.

FIG. 9 is a flow diagram illustrating the operating process of the EPD driving apparatus having the above-described pulses, according to an embodiment of the present invention. The control unit 100 confirms whether the current temperature is higher than the reference temperature in step 401. If the current temperature is higher than the reference temperature, the control unit 100 operates in a single mode in step 403. If the current temperature is lower than the reference temperature, the control unit 100 operates in a multi-mode in step 409. If a display change request is generated in step 405 while in the single mode, the control unit 100 controls the driving unit 200 to apply the driving voltage pulse, which is kept at the same level for the corresponding voltage applying period, to the respective particles in step 407. The applied driving voltage, i.e., the pulse waveforms of the reference voltage and the operating voltage for the respective particles, is shown in FIG. 5.

Figure 10:
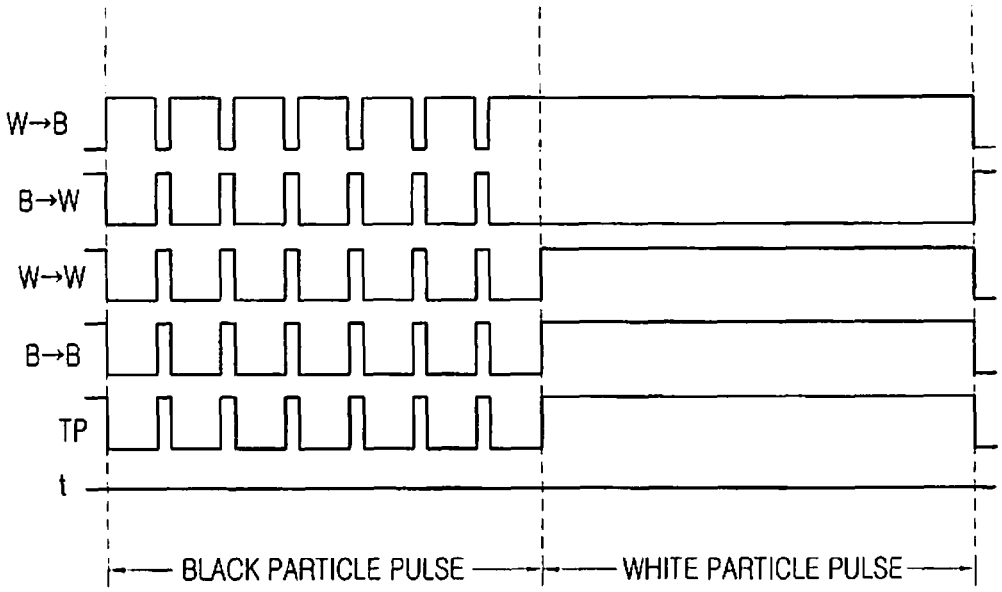
FIG. 10 is a diagram illustrating driving voltage pulses in a multi-mode, according to an embodiment of the present invention.

If a display change request is generated in step 411 while in the multi-mode, the control unit 100 controls the driving unit 200 to apply the driving voltage of a periodic pulse to the black particles 303 and to apply the driving voltage, which is kept at the same level, to the white particles in step 413. The applied driving voltage, i.e., the pulse waveforms of the reference voltage and the operating voltage for the respective particles, is shown in FIG. 10.

Figure 11:
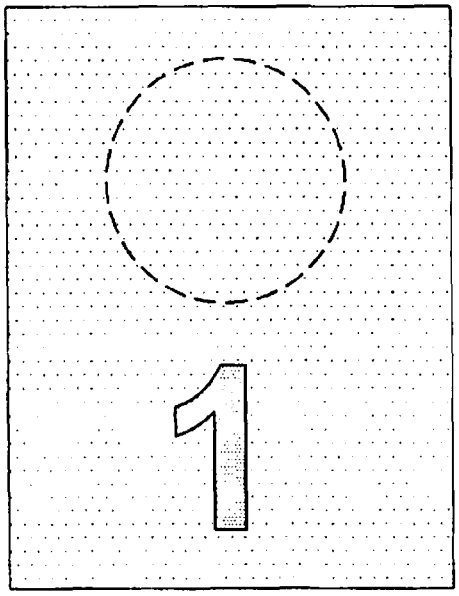
FIG. 11 is diagram illustrating a display screen, according to an embodiment of the present invention.

If the display data is changed from "H" to "1" in a state in which the current temperature is lower than the reference voltage and the EPD driving apparatus operates in a multi-mode, the display screen is shown in FIG. 11. When the display screens of FIG. 6 and FIG. 11 are compared, the whole contrast is clear on the display screen of FIG. 6, but an afterimage of "H" does not remain on the display screen of FIG. 11.

As described above, according to an embodiment of the present invention, by adjusting the pulse waveform of the driving voltage that is applied to the respective particles in accordance with the movement characteristics of the respective color particles 301 and 303 at a temperature below an inactive temperature, the two kinds of particles can move at the same speed. Thus, the data can be displayed without any afterimage. Additionally, since the voltage that is applied to the EPD particles can be controlled in accordance with the ambient temperature, the data can be clearly displayed on the EPD.

While the invention has been shown and described with reference to certain embodiments thereof, it will be understood by those skilled in the art that various changes in form and detail may be made therein without departing from the spirit and scope of the invention as defined by the appended claims.

What is claimed is:

1. A method of driving an ElectroPhoretic Display (EPD) so that a device having the EPD including first color particles and second color particles changes a display as an electrophoresis element, the method comprising the steps of:

applying a driving voltage with a periodic pulse to the first color particles for a voltage applying period of the first color particles, when a current temperature is below a predetermined temperature, wherein the first color particles have a higher mobility than the second color particles;

applying a driving voltage with a pulse that is kept at the same level as applied to the second color particles for a voltage applying period of the second color particles; and applying the driving voltage with the pulse that is kept at the same level to the first color particles when the current temperature is higher than the predetermined temperature, wherein the voltage applying period of the first color particles and the voltage applying period of the second color particles are equal, and a pulse rate of the periodic pulse is determined in accordance with a difference in mobility between the first color particles and the second color particles at the predetermined temperature.

2. The method as claimed in claim 1, wherein the voltage applying period is determined based on the mobility of the second color particles.

3. The method as claimed in claim 2, wherein the predetermined temperature is a temperature that is lower than a temperature at which the mobility of the first and second color particles is weakened in comparison to an ambient temperature.

4. An apparatus for driving an ElectroPhoretic Display (EPD) for changing a display, comprising:

an EPD including first color particles and second color particles as an electrophoresis element;

a driving unit that applies a driving voltage in the form of a pulse to the EPD; and a control unit that controls the driving unit to apply a driving voltage with a periodic pulse to the first color particles for a voltage applying period of the first color particles when a current temperature is below a predetermined temperature, controls the driving unit to apply a driving voltage with a pulse that is kept at the same level as applied to the second color particles for a voltage applying period of the second color particles, and controls the driving unit to applies the driving voltage with the pulse that is kept at the same level to the first color particles if the current temperature is higher than the predetermined temperature, wherein the first color particles have a higher mobility than the second color particles, and wherein the voltage applying period of the first color particles and the voltage applying period of the second color particles are equal, and a pulse rate of the periodic pulse is determined in accordance with a difference in mobility between the first color particles and the second color particles at the predetermined temperature.

5. The apparatus as claimed in claim 4, wherein the voltage applying period is determined based on the mobility of the second color particles.

6. The apparatus as claimed in claim 5, wherein the predetermined temperature is a temperature that is lower than a temperature at which the mobility of the first and second color particles is weakened in comparison to an ambient temperature.

* * * * *